US007600833B2

(12) United States Patent
Oh et al.

(10) Patent No.: US 7,600,833 B2
(45) **Date of Patent: *Oct. 13, 2009**

(54) REFRIGERATOR HAVING BASKET LIFT APPARATUS

(75) Inventors: Seung-Hwan Oh, Gyeonggi-Do (KR); Kyung-Han Jeong, Seoul (KR); Sang-Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 243 days.

This patent is subject to a terminal disclaimer.

(21) Appl. No.: 11/217,359

(22) Filed: Sep. 2, 2005

(65) Prior Publication Data

US 2006/0013677 A1 Jan. 19, 2006

Related U.S. Application Data

(63) Continuation of application No. 11/028,633, filed on Jan. 5, 2005.

(30) Foreign Application Priority Data

Jul. 15, 2004 (KR) ..... 10-2004-0055262

(51) Int. Cl.
*A47B 96/04* (2006.01)
*A47B 95/02* (2006.01)

(52) U.S. Cl. ..... 312/404; 312/402; 312/319.5

(58) Field of Classification Search ..... 312/404, 312/401, 400, 402, 330.1, 319.1–319.9, 304, 312/306, 307, 21–30, 223.2, 234.44; 108/144.11, 108/145, 148; 62/407; 188/171, 161, 163, 188/322.5; 192/143, 144; 310/77, 93, 94; 74/49, 50, 55, 53, 411.5, 89.17, 422
See application file for complete search history.

(56) References Cited

U.S. PATENT DOCUMENTS

| | | | | | |
|---|---|---|---|---|---|
| 2,509,806 | A | * | 5/1950 | Byars | 312/241 |
| 2,861,857 | A | * | 11/1958 | Lee et al. | 312/312 |
| 2,879,124 | A | * | 3/1959 | Maxfield et al. | 312/242 |
| 3,246,939 | A | | 4/1966 | Petkwitz et al. | |
| 4,065,194 | A | * | 12/1977 | Mattia | 312/247 |
| 4,568,132 | A | * | 2/1986 | Watt | 312/312 |

(Continued)

FOREIGN PATENT DOCUMENTS

DE 297 01 227 U1 6/1997

(Continued)

OTHER PUBLICATIONS

Machine translation of JP 05-296647 from http://dossier.ipdl.inpit.go.jp/text_trans.html.*

*Primary Examiner*—Janet M Wilkens
*Assistant Examiner*—Timothy M Ayres
(74) *Attorney, Agent, or Firm*—Birch, Stewart, Kolasch & Birch, LLP

(57) ABSTRACT

A refrigerator having a basket lift apparatus comprises: a body having cooling chambers for storing food; a basket accommodated in the cooling chamber in a slidable manner; and a basket lift apparatus installed at the basket and lifting the basket when the basket is drawn out of the cooling chamber. When the basket is drawn out of the lower cooling chamber, the basket is lifted by using the basket lifting apparatus thereby to enhance the user's convenience.

12 Claims, 7 Drawing Sheets

U.S. PATENT DOCUMENTS

| | | | | | |
|---|---|---|---|---|---|
| 4,790,611 | A | * | 12/1988 | Craner | 312/306 |
| 5,323,695 | A | * | 6/1994 | Borgman et al. | 108/147 |
| 5,429,043 | A | * | 7/1995 | Becker | 99/448 |
| 5,586,816 | A | * | 12/1996 | Geiss, II | 312/301 |
| 5,971,513 | A | * | 10/1999 | Cassalia | 312/310 |
| 2004/0100168 | A1 | | 5/2004 | Choi | |
| 2005/0073225 | A1 | | 4/2005 | Kwon et al. | |

FOREIGN PATENT DOCUMENTS

| | | | |
|---|---|---|---|
| GB | 2 406 633 | A | 4/2005 |
| JP | 05-296647 | A | 11/1993 |
| KP | 2003-0000632 | A | 1/2003 |
| KR | 100159711 | B1 | 8/1998 |
| WO | WO-01/71263 | A1 | 9/2001 |

* cited by examiner

REFRIGERATOR HAVING BASKET LIFT APPARATUS

This application is a Continuation of co-pending application Ser. No. 11/028,633, filed on Jan. 5, 2005, and for which priority is claimed under 35 U.S.C. § 120, and this application claims priority of Application No. 55262/2004 filed in Korea on Jul. 15, 2004 under 35 U.S.C. § 119, the entire contents of which are hereby incorporated by reference.

BACKGROUND OF THE INVENTION

1. Field of the Invention

The present invention relates to a refrigerator having a basket lift apparatus, and more particularly, to a refrigerator having a basket lift apparatus capable of enhancing a user's convenience by lifting a basket installed at a lower portion of a body.

2. Description of the Conventional Art

FIG. 1 is a perspective view showing a refrigerator in accordance with the conventional art, and FIG. 2 is a sectional view of a refrigerator showing a state that a basket is accommodated in a body.

The conventional refrigerator comprises: a body 102 having an opened front side and an accommodation space; an upper cooling chamber 106 arranged at an upper side of the body 102 and having a pair of upper doors 104 opened to both sides, for storing food; and a lower cooling chamber 112 arranged at a lower side of the body 102, separated from the upper cooling chamber 106 by a partition wall 108, and having a lower door 110 opened in a slidable manner.

A mechanical chamber 116 having a compressor 114 for generating cold air to be supplied to the upper cooling chamber 106 and the lower cooling chamber 112, etc. is installed at a rear side of the body 102.

A basket 120 for accommodating food is arranged at the lower cooling chamber 112 to be slidable back and forth, and the lower door 110 is fixed at a front side of the basket 120. According to this, when the lower door 110 is pulled, the basket 120 is opened, and when the lower door 110 is pushed, the basket 120 is closed. A guide rail 124 is installed between an inner side surface of the basket 120 and an inner side surface of the lower cooling chamber 112, thereby guiding the basket 120 to be slidable back and forth.

A plurality of drawers 126 for storing food are installed at an upper side of the basket 120 to be opened in a slidable manner.

In the conventional refrigerator, when a user forwardly pulls the lower door 110 in order to take out the food stored in the lower cooling chamber 112 or in order to accommodate food in the lower cooling chamber 112, the basket 120 is opened with a slide motion. Also, when the user backwardly pushes the lower door 110 after taking out the food stored in the basket 120 or accommodating food in the basket 120, the basket 120 is closed with a slide motion.

However, in the conventional refrigerator, since the basket is arranged at a lower portion of the refrigerator, the user has to bend his or her waist or has to crouch in order to take out the food stored in the basket or to accommodate food in the basket thereby to have inconvenience in using the basket.

SUMMARY OF THE INVENTION

Therefore, an object of the present invention is to provide a refrigerator having a basket lift apparatus capable of enhancing a user's convenience by elevating a position of a basket by lifting the basket when the basket arranged at a lower portion of a body is drawn out of a lower cooling chamber.

To achieve these and other advantages and in accordance with the purpose of the present invention, as embodied and broadly described herein, there is provided a refrigerator comprising: a body having cooling chambers for storing food; a basket accommodated in the cooling chamber in a slidable manner; and a basket lift apparatus for lifting the basket when the basket is drawn out of the cooling chamber.

A door movable in back and forth directions of the body is arranged at a front side of the cooling chamber, and a guide rail for guiding the door to be slidable back and forth is installed between the door and both lateral surfaces of the cooling chamber.

The basket lift apparatus is composed of: a lifting frame arranged at a rear surface of the door to be movable up and down, and on which the basket is positioned; and a driving unit for moving the lifting frame up and down.

The driving unit is composed of: a driving arm having one end contacting a lower surface of the lifting frame to be movable back and forth, and another end rotatably mounted at a rear surface of the lower door; a driving motor fixed to the rear surface of the lower door and rotating the driving arm; and a power transmitting unit for transmitting a driving force generated from the driving motor to the driving arm.

A roller roll-motioned at a lower surface of the lifting frame is mounted at one end of the driving arm, and a hinge shaft is mounted at another end of the driving arm. The hinge shaft is rotatably supported at a supporting frame fixed to the rear surface of the lower door.

The basket lift apparatus further includes a control unit for controlling the driving unit and thereby lifting the basket when the basket is drawn out of the cooling chamber. The control unit is composed of: switches adjusted by a user; a first sensor mounted at an upper end of the door, for sensing a position that the basket is lifted to the maximum; a second sensor mounted at a lower end of the door, for sensing a position that the basket is descended to the maximum; and a controller for controlling the driving motor according to a signal applied from the switches, the first sensor, and the second sensor.

The refrigerator according to the present invention comprises: a body having an accommodation space; an upper cooling chamber arranged at an upper side of the body and having a pair of upper doors opened to both sides; a lower cooling chamber arranged at a lower side of the body, separated from the upper cooling chamber by a partition wall, and having a lower door opened in back and forth directions; a basket arranged at the lower cooling chamber to be slidable back and forth, for storing food; and a basket lift apparatus installed between the basket and the lower door, for lifting the basket.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a refrigerator having a basket lift apparatus according to the present invention will be explained in more detail with reference to the attached drawings.

Even if there may exist a plurality of preferred embodiments of the refrigerator having a basket lift apparatus according to the present invention, the most preferred embodiment will be explained hereinafter.

Figure 1:
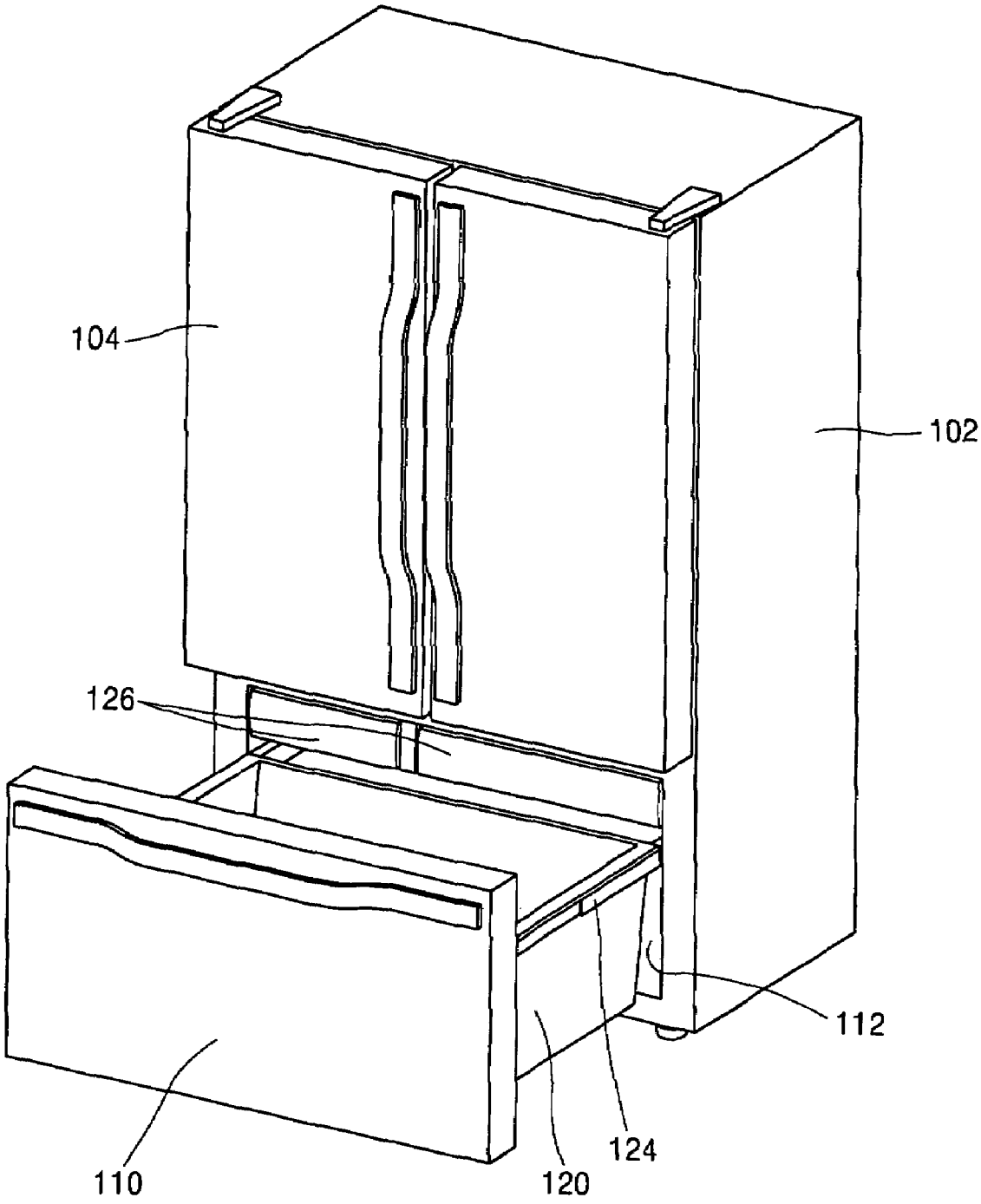
FIG. 1 CONVENTIONAL ART
FIG. 1 is a perspective view of a refrigerator in accordance with the conventional art.
Figure 2:
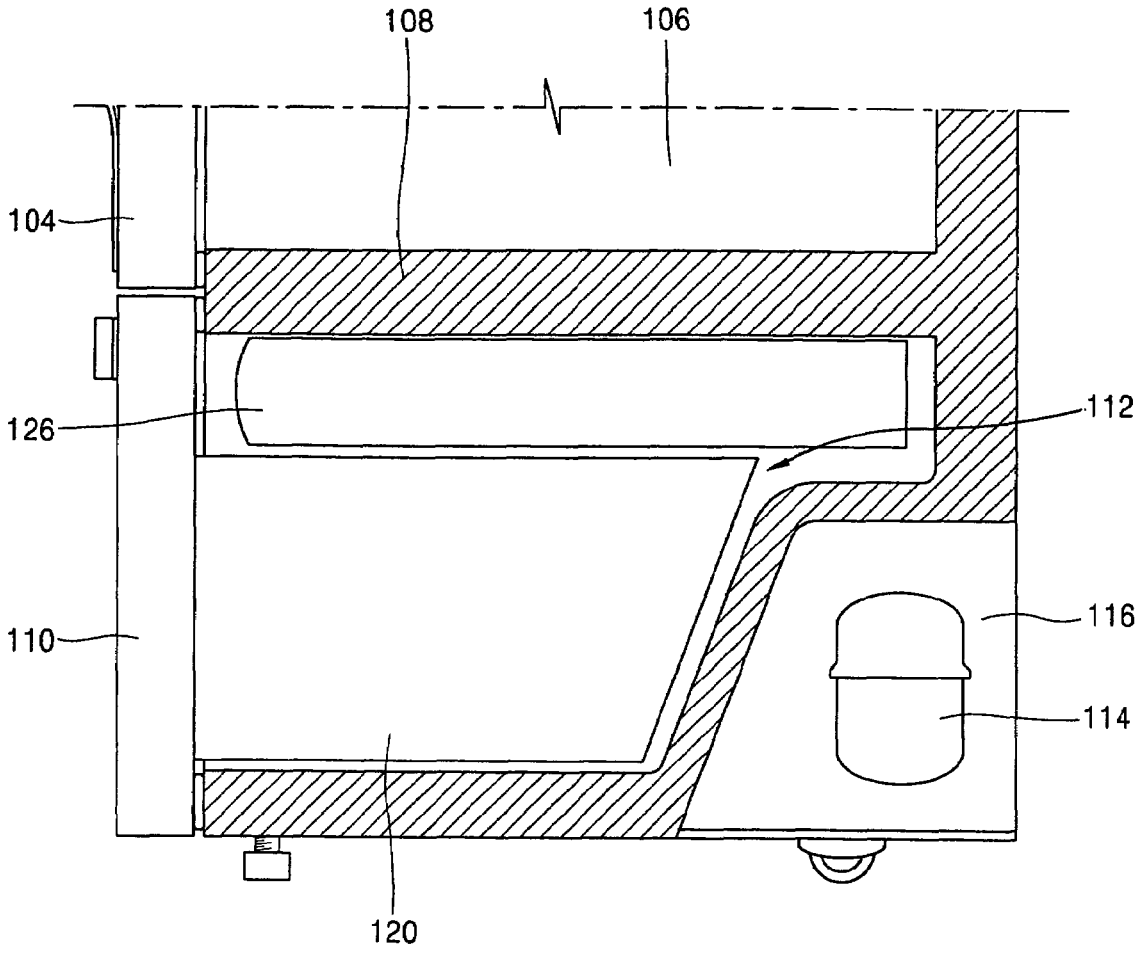
FIG. 2 CONVENTIONAL ART
FIG. 2 is a sectional view showing a lower portion of the refrigerator in accordance with the conventional art.
Figure 3:
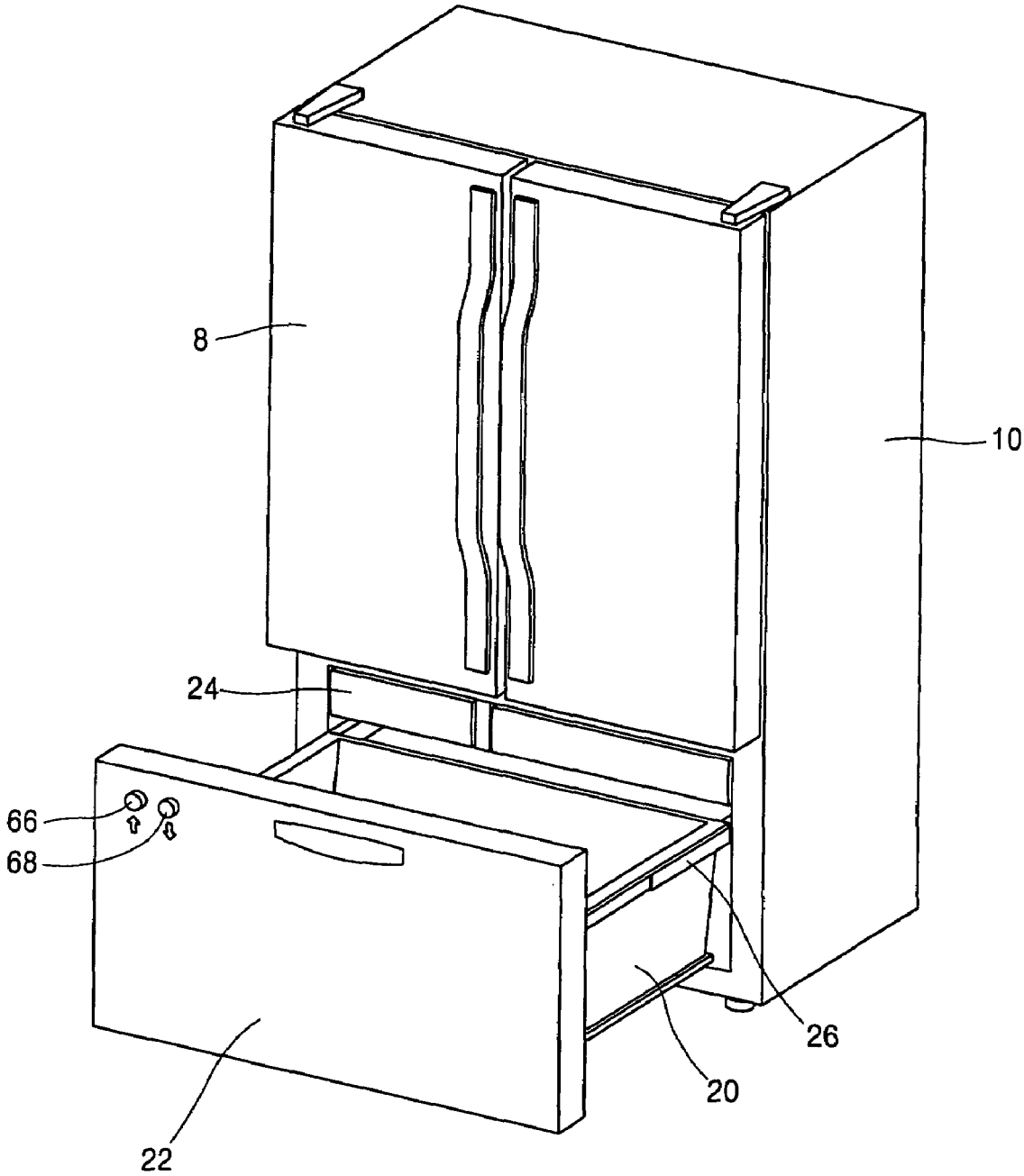
FIG. 3 is a perspective view of a refrigerator according to the present invention.
Figure 4:
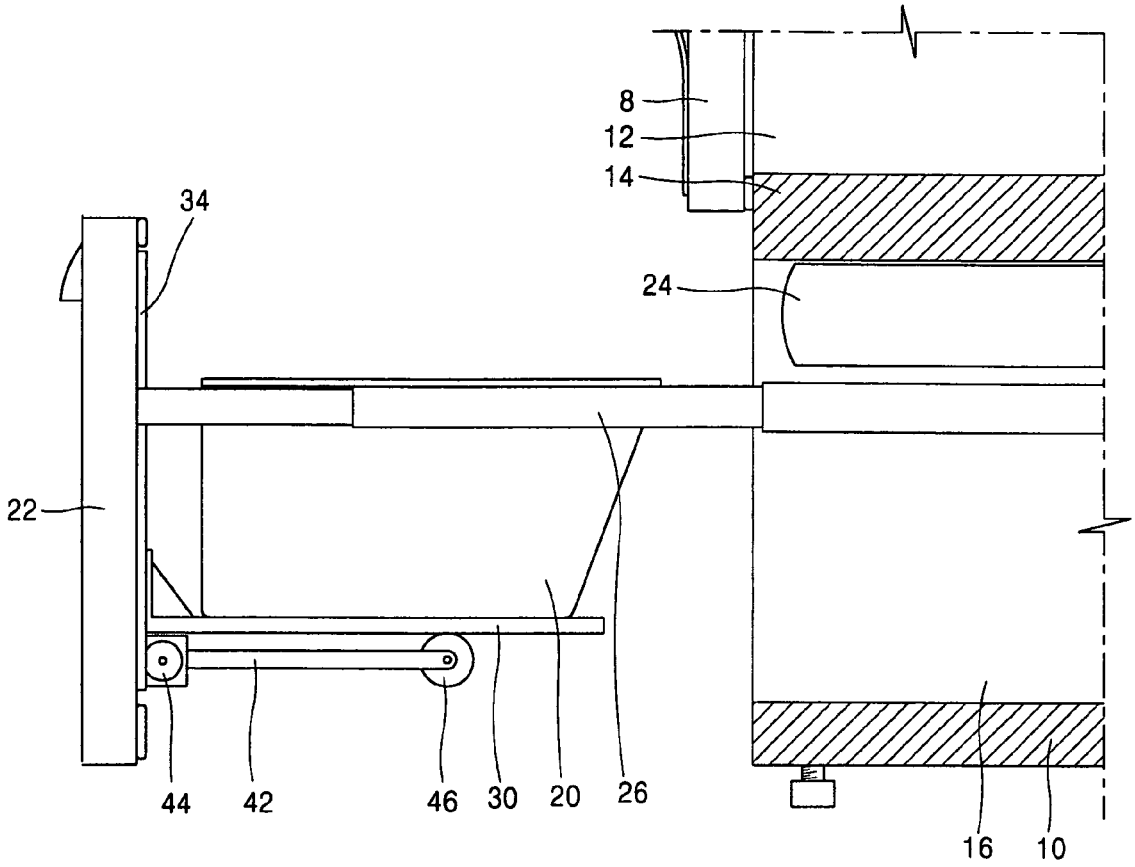
FIG. 4 is a sectional view showing a basket lift apparatus of a refrigerator according to the present invention.

FIG. 3 is a perspective view of a refrigerator according to the present invention, and FIG. 4 is a sectional view showing a basket lift apparatus of the refrigerator according to the present invention.

The refrigerator according to the present invention comprises: a body 10 having an accommodation space; an upper cooling chamber 12 arranged at an upper side of the body 10 and having a pair of upper doors 8 opened to both sides; a lower cooling chamber 16 arranged at a lower side of the body 10 and separated from the upper cooling chamber 12 by a partition wall 14; a basket 20 arranged at the lower cooling chamber 16 to be slidable back and forth, for storing food; and a basket lift apparatus for lifting up the basket 20 when the basket 20 is drawn out of the lower cooling chamber.

Preferably, the upper cooling chamber 12 is used as a cooling chamber for storing refrigerating food items, and the lower cooling chamber 16 is used as a freezing chamber for storing freezing food items.

A lower door 22 for pushing the basket 20 or drawing the basket 20 out of the lower cooling chamber 16 along back and forth directions of the body 10 is arranged at a front side of the lower cooling chamber 16. A plurality of drawers 24 drawn out along back and forth directions of the body 10 and for storing food are installed at an upper side of the lower cooling chamber 16.

A pair of guide rails 26 for guiding the lower door 22 to be slidable along back and forth directions of the body 10 is installed between both lateral surfaces of the lower cooling chamber 16 and a rear surface of the lower door 22.

Figure 5:
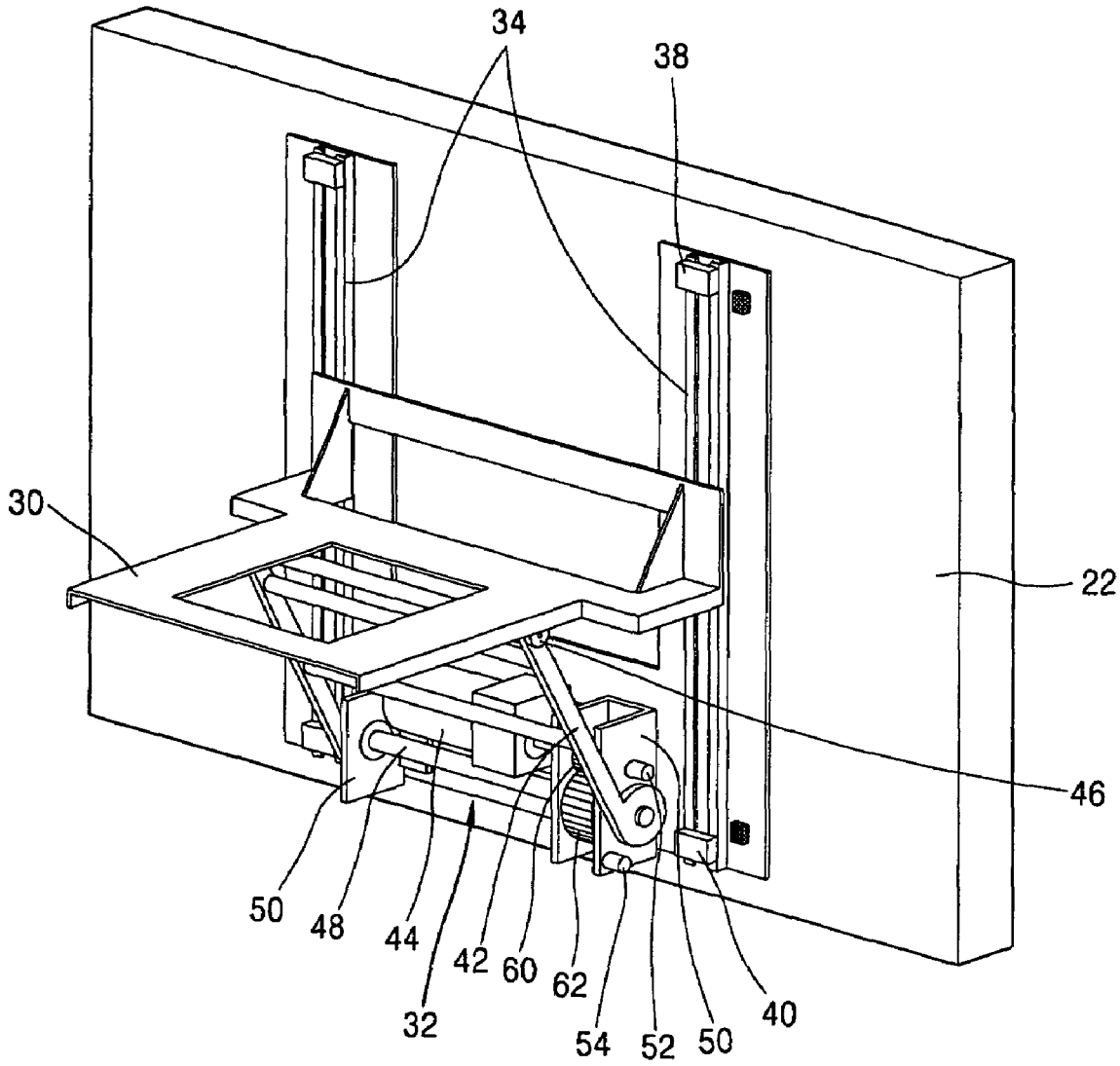
FIG. 5 is a perspective view showing the basket lift apparatus of a refrigerator according to the present invention.
Figure 6:
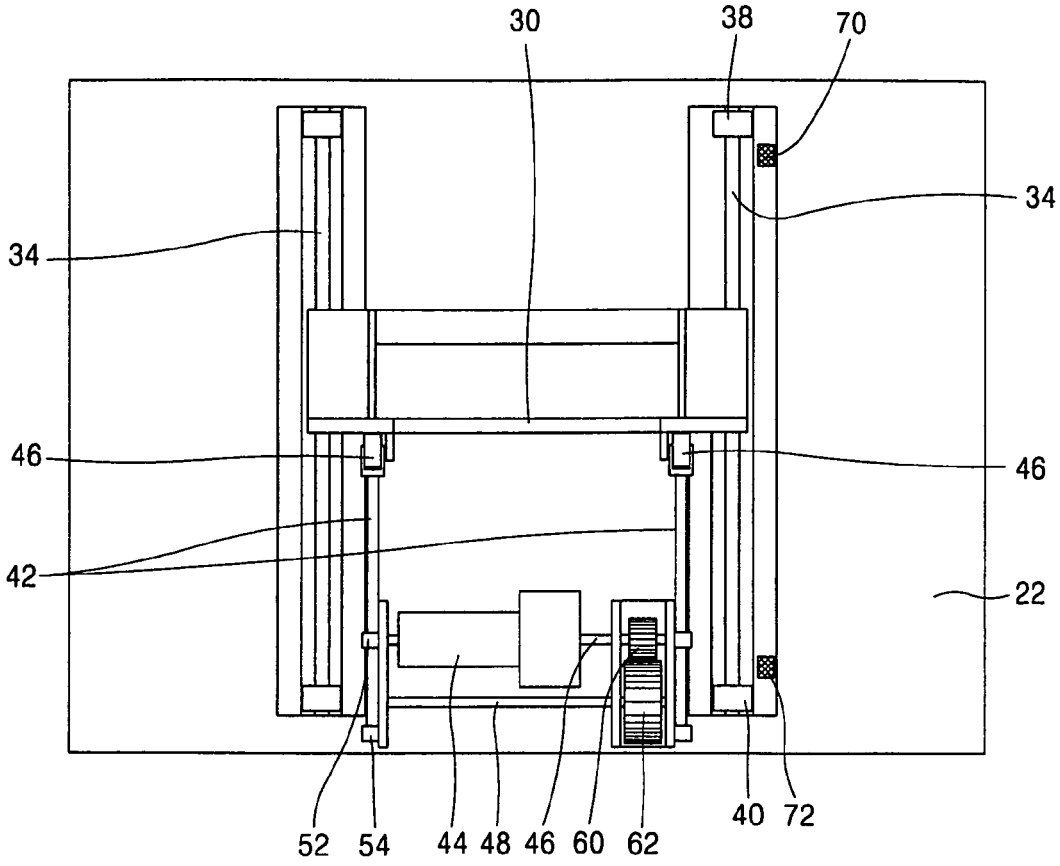
FIG. 6 is a frontal view showing the basket lift apparatus of a refrigerator according to the present invention.

As shown in FIGS. 5 and 6, the basket lift apparatus includes: a lifting frame 30 arranged at a rear surface of the lower door 22 to be movable up and down, and on which the basket 20 is positioned; a driving unit 32 for moving the lifting frame 30 up and down; and a control unit for driving the driving unit 32 and thereby lifting the basket 20 when the basket 20 is drawn out of the lower cooling chamber.

The lifting frame 30 is formed as a flat plate type on which the basket 20 is positioned. One side surface of the lifting frame 30 is bent as a right angle and is mounted at the rear surface of the lower door 22 to be movable up and down.

A pair of lifting rails 34 are fixed to the rear surface of the lower door 22 in a vertical direction, and the lifting frame 30 is mounted at the lifting rail 34 to be slidable up and down.

An upper stopper 38 and a lower stopper 40 are respectively mounted at an upper end and a lower end of the lifting rail 34, thereby preventing the lifting frame 30 from being detached from the lower door 22.

The driving unit 32 is composed of: a driving arm 42 having one end contacting the lower surface of the lifting frame 30 to be movable back and forth, and another end rotatably mounted at the rear surface of the lower door 22; a driving motor 44 fixed to the rear surface of the lower door 22, for lifting the lifting frame 30 by rotating the driving arm 42; and a power transmitting unit for transmitting a rotation force generated from the driving motor 44 to the driving arm 42. As best seen in FIG. 6, a distance between the connection of the lifting frame 30 to the lifting rails 34 measured in a lateral direction of the lower door 22 is greater than a distance between the pair of driving arms 52 measured in the lateral direction of the lower door 22.

A roller 47 roll-motioned at the lower surface of the lifting frame 30 is mounted at one end of the driving arm 42, and a hinge shaft 48 is mounted at another end of the driving arm 42. The hinge shaft 48 is rotatably supported at a supporting frame 50 fixed to the rear surface of the lower door 22.

A first stopper 52 and a second stopper 54 for limiting a rotation range of the driving arm 42 are respectively formed at a lateral surface of the supporting frame 50.

The power transmitting unit is composed of: a driving gear 60 fixed to a rotation shaft 46 of the driving motor 44 and arranged in the supporting frame 50; and a driven gear 62 gear-engaged with the driving gear 60 and fixed to the hinge shaft 48.

The driving arm 42 is constructed as one pair respectively arranged at both sides of the lifting frame 30, and the hinge shaft 48 is extended to fix the driving arms 42 at both end portions thereof.

When the driving motor 44 is driven, the driving gear 60 is rotated and thereby the driven gear 62 gear-engaged with the driving gear 60 is rotated. According to this, the hinge shaft 48 is rotated, and thereby the driving arm 42 is rotated.

Figure 7:
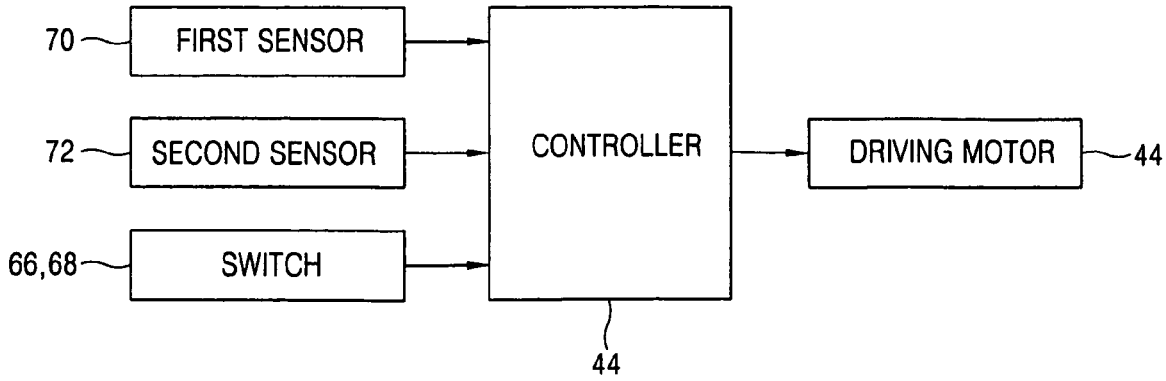
FIG. 7 is a block diagram showing a control unit of the basket lift apparatus of a refrigerator according to the present invention.

As shown in FIG. 7, the control unit for driving the driving motor 44 in a forward direction or in a backward direction by a user's adjustment is composed of: switches 66 and 68 adjusted by a user; a first sensor 70 mounted at an upper end of the lifting rail 34, for sensing a state that the lifting frame 30 is lifted to the maximum; a second sensor 72 mounted at a lower end of the lifting rail 34, for sensing a state that the lifting frame 30 is descended to the maximum; and a controller 80 for controlling the driving motor 44 according to a signal applied from the switches 66 and 68, the first sensor 70, and the second sensor 72.

The switches are composed of: a first switch 66 mounted at a front surface of the lower door 22 and adjusted by the user when the lifting frame 30 is to be lifted up; and a second switch 68 mounted at the front surface of the lower door 22 and adjusted by the user when the lifting frame 30 is to be descended.

The first sensor 70 and the second sensor 72 are preferably constructed as a limit switch for applying a signal to the controller 80 at the time of being in contact with the lifting frame 30 or the basket 20 positioned on the lifting frame 30, or are constructed as an optical sensor.

An operation of the basket lift apparatus according to the present invention will be explained as follows.

Figure 8:
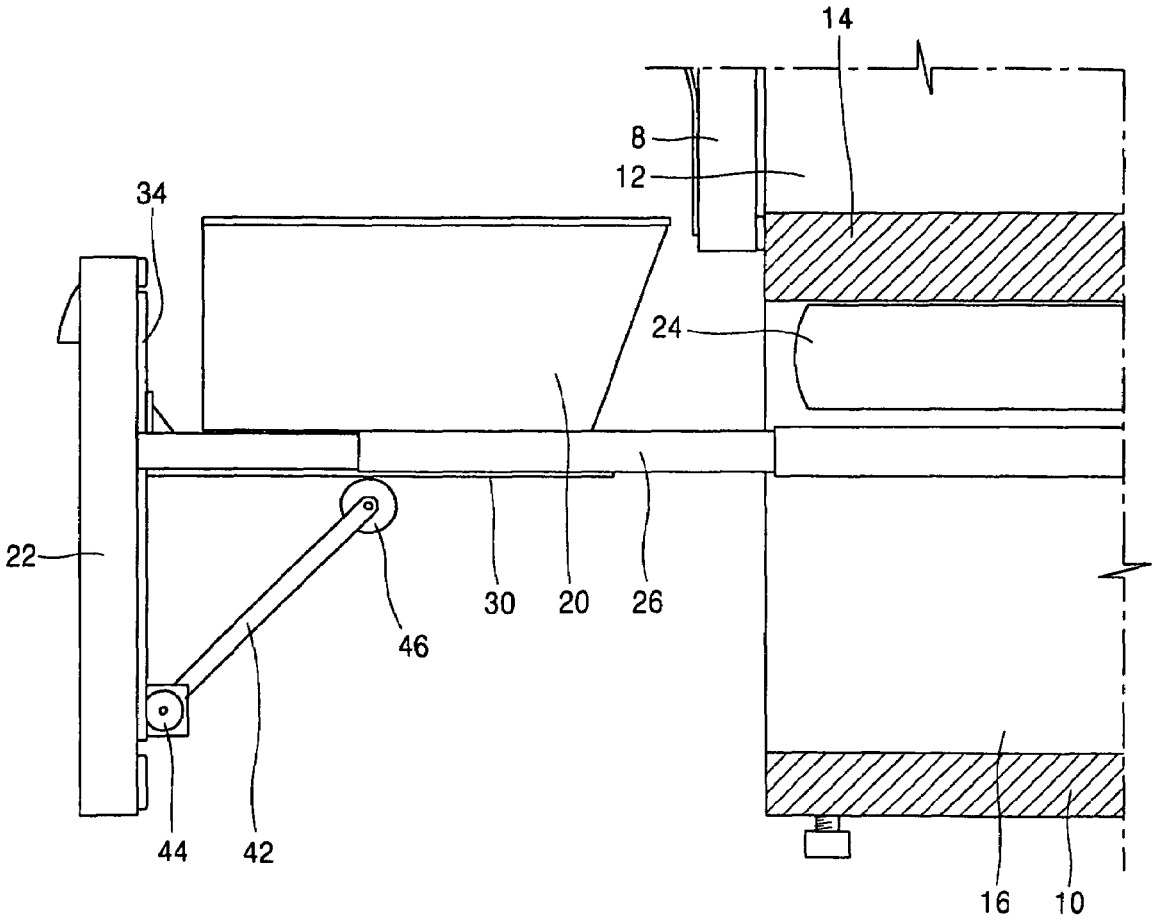
FIG. 8 is an operation state view showing the basket lift apparatus of a refrigerator according to the present invention.

FIG. 8 is a lateral view showing a lifted state of the basket lift apparatus of a refrigerator according to the present invention.

The user forwardly pulls the lower door 22 in order to take out food stored in the basket 20 thereby to draw the basket 20 out of the lower cooling chamber 16, and then adjusts the first switch 66 mounted at the front surface of the lower door 22. According to this, a signal is applied to the controller 80 from the first switch 66, and the controller 80 forwardly drives the driving motor 44.

According to this, the rotation shaft 46 of the driving motor 44 is rotated, and the driving gear 60 fixed to the rotation shaft 46 is rotated. As the driving gear 60 is rotated, the driven gear 62 gear-engaged with the driving gear 60 is rotated thereby to rotate the hinge shaft 48. According to this, another end of the driving arm 42 fixed to the hinge shaft 48 is rotated, and thus the roller 47 mounted at one end of the driving arm 42 is roll-motioned at the lower surface of the lifting frame 30, thereby lifting the lifting frame 30. When the lifting frame 30 is lifted to the maximum, the first sensor 70 senses the lifted state of the lifting frame 30 and applies the sensed signal to the controller 80. Then, the controller 80 stops the driving motor 44.

Under this state, when the user adjusts the second switch 68 after taking out food stored in the basket 20, the controller 80 drives the driving motor 44 in a backward direction thus to descend the lifting frame 30. When the descent of the lifting frame 30 is completed, the second sensor 72 senses the descended state of the lifting frame 30 and applies the sensed signal to the controller 80. Then, the controller 80 stops the driving motor 44.

When the user backwardly pushes the lower door 22, the basket 20 is accommodated in the lower cooling chamber 16.

Effects of the refrigerator having the basket lift apparatus according to the present invention will be explained as follows.

When the basket is drawn out of the lower cooling chamber, the basket is lifted by using the basket lift apparatus. According to this, the user can take out food stored in the basket without bending his or her waist thus to enhance the user's convenience.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for raising and lowering a basket of a refrigerator comprising:

providing a refrigerator having:

a basket door;

a pair of lifting rails connected to a rear surface of the basket door;

a lifting frame having a lifting portion movably connected to each of the pair of lifting rails, and a loading portion extending from the lifting portion for loading the basket; and a basket driving unit for driving the lifting frame, the basket driving unit including:

a pair of driving arms, each driving arm contacting the lifting frame and being hinge-connected to the basket door, for lifting the lifting frame, each driving arm being provided with a roller roll-movably in contact with a lower surface of the loading portion of the lifting frame at one end thereof, the pair of driving arms being connected by a hinge shaft extending therebetween, wherein the hinge shaft is rotatably supported by a supporting frame fixed to the rear surface of the basket door; and a driving motor for generating a driving force to rotate the pair of driving arms, wherein a distance between the connections of the lifting portion to the lifting rails measured in a lateral direction of the door is greater than a distance between the pair of driving arms measured in the lateral direction of the door;

inputting a signal for lifting or lowering the basket supported by the lifting frame;

driving the basket driving unit in a forward direction or a backward direction according to the signal inputted to lift or lower the basket; and stopping the basket when the basket reaches a maximum position or a minimum position, wherein lifting and lowering the basket is controlled by rolling the roller forwardly or rearwardly at the lower surface of the lifting frame, thereby lifting or lowering the basket.

2. The method of claim 1, wherein the step of inputting a signal is performed by controlling an adjustment switch installed at the basket door.

3. The method of claim 1, wherein the step of driving the basket driving unit is performed by applying power to the driving motor in a forward direction or a backward direction.

4. The method of claim 1, wherein the step of stopping the basket driving unit is performed by signals applied from at least one of sensors for detecting a position that the basket is lifted to the maximum position and a position that the basket is lowered to the minimum position.

5. The method of claim 1, further comprising stopping the basket driving unit when an alarm signal is inputted while the basket driving unit is operated.

6. The method of claim 5, wherein the step of inputting the alarm signal is performed by controlling an alarm switch installed at the basket door.

7. A method for raising and lowering a basket of a refrigerator comprising:

providing a refrigerator having:

a basket door;

a pair of lifting rails connected to a rear surface of the basket door;

a lifting frame having a lifting portion movably connected to each of the pair of lifting rails, and a loading portion extending from the lifting portion for loading the basket; and a basket driving unit for driving the lifting frame, the driving unit including:

a pair of driving arms, each driving arm contacting the lifting frame and being hinge-connected to the basket door, for lifting the lifting frame, each driving arm being provided with a roller roll-movably in contact with a lower surface of the loading portion of the lifting frame at one end thereof, the pair of driving arms being connected by a hinge shaft extending therebetween, wherein the hinge shaft is rotatably supported by a supporting frame fixed to the rear surface of the basket door; and a driving motor for generating a driving force to rotate the pair of driving arms, wherein a distance between the connections of the lifting portion to the lifting rails measured in a lateral direction of the door is greater than a distance between the pair of driving arms measured in the lateral direction of the door;

inputting a signal for lifting the basket supported by the lifting frame;

driving the basket driving unit in a forward direction according to the signal inputted for lifting the basket;

stopping the basket driving unit when the basket reaches a maximum position during driving the basket driving unit in the forward direction;

inputting a signal for lowering the basket after the basket reaches the maximum position;

driving the basket driving unit in a backward direction according to the signal inputted for lowering the basket; and stopping the basket driving unit when the basket reaches a minimum position during driving the basket driving unit in the backward direction, wherein lifting and lowering the basket is controlled by rolling the roller forwardly or rearwardly at the lower surface of the lifting frame, thereby lifting or lowering the basket.

8. The method of claim 7, wherein inputting the signal for lifting the basket is performed by controlling a first switch installed at the basket door.

9. The method of claim 7, wherein stopping the basket driving unit when the basket reaches the maximum position is performed by a signal applied from a first sensor installed at an upper portion of the basket door.

10. The method of claim 7, wherein inputting the signal for lowering the basket is performed by controlling a second switch installed at the basket door.

11. The method of claim 7, wherein stopping the basket driving unit when the basket reaches the minimum position is performed by a signal applied from a second sensor installed at a lower portion of the basket door.

12. The method of claim 7, further comprising stopping the basket driving unit when an alarm signal is inputted while the basket driving unit is operated.

* * * * *